US009565940B2

(12) United States Patent
Wilson et al.

(10) Patent No.: US 9,565,940 B2
(45) Date of Patent: Feb. 14, 2017

(54) SYSTEMS AND METHODS FOR SEMI-MOVEABLE OBJECTS

(71) Applicant: Revolution Solutions, LLC, Gilroy, CA (US)

(72) Inventors: George Wilson, Gilroy, CA (US); Dinesh Amin, Gilroy, CA (US)

(73) Assignee: Revolution Solutions, LLC, Gilroy, CA (US)

( * ) Notice: Subject to any disclaimer, the term of this patent is extended or adjusted under 35 U.S.C. 154(b) by 0 days.

(21) Appl. No.: 14/814,836

(22) Filed: Jul. 31, 2015

(65) Prior Publication Data

US 2016/0029793 A1 Feb. 4, 2016

Related U.S. Application Data

(60) Provisional application No. 62/032,384, filed on Aug. 1, 2014.

(51) Int. Cl.

| | |
|---|---|
| ***E04C 3/00*** | (2006.01) |
| ***E04D 1/36*** | (2006.01) |
| ***A47B 95/00*** | (2006.01) |
| ***E04F 19/02*** | (2006.01) |
| ***A47B 97/00*** | (2006.01) |

(52) U.S. Cl.

CPC ..... *A47B 95/002* (2013.01); *A47B 97/00* (2013.01); *E04F 19/02* (2013.01)

(58) Field of Classification Search

CPC ... A47B 95/002; A47B 95/0043; A47B 97/00; E04F 19/02

USPC ..... 312/140.4

See application file for complete search history.

(56) References Cited

U.S. PATENT DOCUMENTS

| | | | | |
|---|---|---|---|---|
| 4,723,583 | A * | 2/1988 | Lowe | D06F 39/12 206/320 |
| 5,518,309 | A * | 5/1996 | St-Pierre | D06F 39/12 211/86.01 |
| 7,562,453 | B1 * | 7/2009 | Benner | A01G 13/10 256/1 |
| 2002/0137598 | A1 * | 9/2002 | Publicover | A63B 5/11 482/27 |
| 2003/0230221 | A1 * | 12/2003 | Savoy | A47B 95/002 108/48 |

(Continued)

*Primary Examiner* — Brian Mattei

(74) *Attorney, Agent, or Firm* — Schwegman Lundberg & Woessner, P.A.

(57) ABSTRACT

A system for semi-moveable objects is described. The system comprises a container device including capture mechanism material; a plurality of securing devices including a first plurality of securing devices; and instruction information providing instructions to install a collection device to capture a lightweight object by cutting the capture mechanism material to generate a capture mechanism and fastening the capture mechanism with a securing devices to a semi-moveable object and a supporting structure, the collection device comprising the capture mechanism including a first capture mechanism, and the securing devices including a first type of securing device, the securing devices including a first portion of securing devices and a second portion of securing devices, the first portion of securing devices to fasten the first capture mechanism to a supporting structure and the second portion of the first plurality of securing devices to fasten the first capture mechanism to a semi-moveable object.

18 Claims, 9 Drawing Sheets

(56) References Cited

U.S. PATENT DOCUMENTS

| | | | | |
|---|---|---|---|---|
| 2004/0129183 | A1* | 7/2004 | Owen | A47B 97/00 108/27 |
| 2007/0134457 | A1* | 6/2007 | Dobelle | A47B 95/043 428/36.9 |
| 2008/0178772 | A1* | 7/2008 | Roach | B65F 1/10 108/26 |
| 2009/0066206 | A1* | 3/2009 | Michelson | A47B 95/002 312/237 |
| 2009/0173256 | A1* | 7/2009 | LeMarr | F24C 15/30 108/69 |
| 2012/0304896 | A1* | 12/2012 | Webb, Sr. | A47B 95/002 108/42 |
| 2013/0209727 | A1* | 8/2013 | Orr | A44B 19/30 428/99 |
| 2013/0313387 | A1* | 11/2013 | Ly | F16M 13/02 248/205.3 |
| 2014/0165472 | A1* | 6/2014 | McLemore | E06B 3/34 49/381 |
| 2015/0211240 | A1* | 7/2015 | Coca | A47B 95/002 52/468 |

* cited by examiner

SYSTEMS AND METHODS FOR SEMI-MOVEABLE OBJECTS

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

The present invention relates generally to the field of miscellaneous hardware and, more specifically, to systems and methods for semi-moveable objects.

RELATED APPLICATIONS

This application claims the benefit of U.S. Provisional Patent Application Ser. No. 62/032,384, filed on Aug. 1, 2014 which is incorporated by reference herein in its entirety.

BACKGROUND

Lightweight objects may fall between supporting structures and semi-moveable objects. In some instances those objects may be difficult to recover. In other instances, recovery is not possible without first moving the semi-movable object.

DETAILED DESCRIPTION

Systems and methods for semi-moveable objects are described. A semi-moveable object is an object that may be moved from its resting location but typically remains as positioned because its function is facilitated by its location. The system may be used to collect lightweight objects that otherwise may fall between one or more semi-moveable objects and a supporting structure. Merely for example, in a household with a washer and dryer, clothing on top of one or both machines may be pushed off the back or sides of the machines without any awareness of a user. A lightweight object is an object with a weight that is approximately five pound or less (e.g., pen, pencil, article of clothing, baseball, etc.).

This disclosure relates to clothing, or other items, falling behind, or to the sides, of a semi-moveable object(s) (e.g., washer and/or dryer). To this end, a capture mechanism (e.g., "catch all," "capture net," etc.) may be applied to one or more semi-moveable objects and supporting structures with securing devices to capture, restrain, or prevent items from dropping or falling into gaps between the semi-moveable object and supporting structure.

Figure 1A:
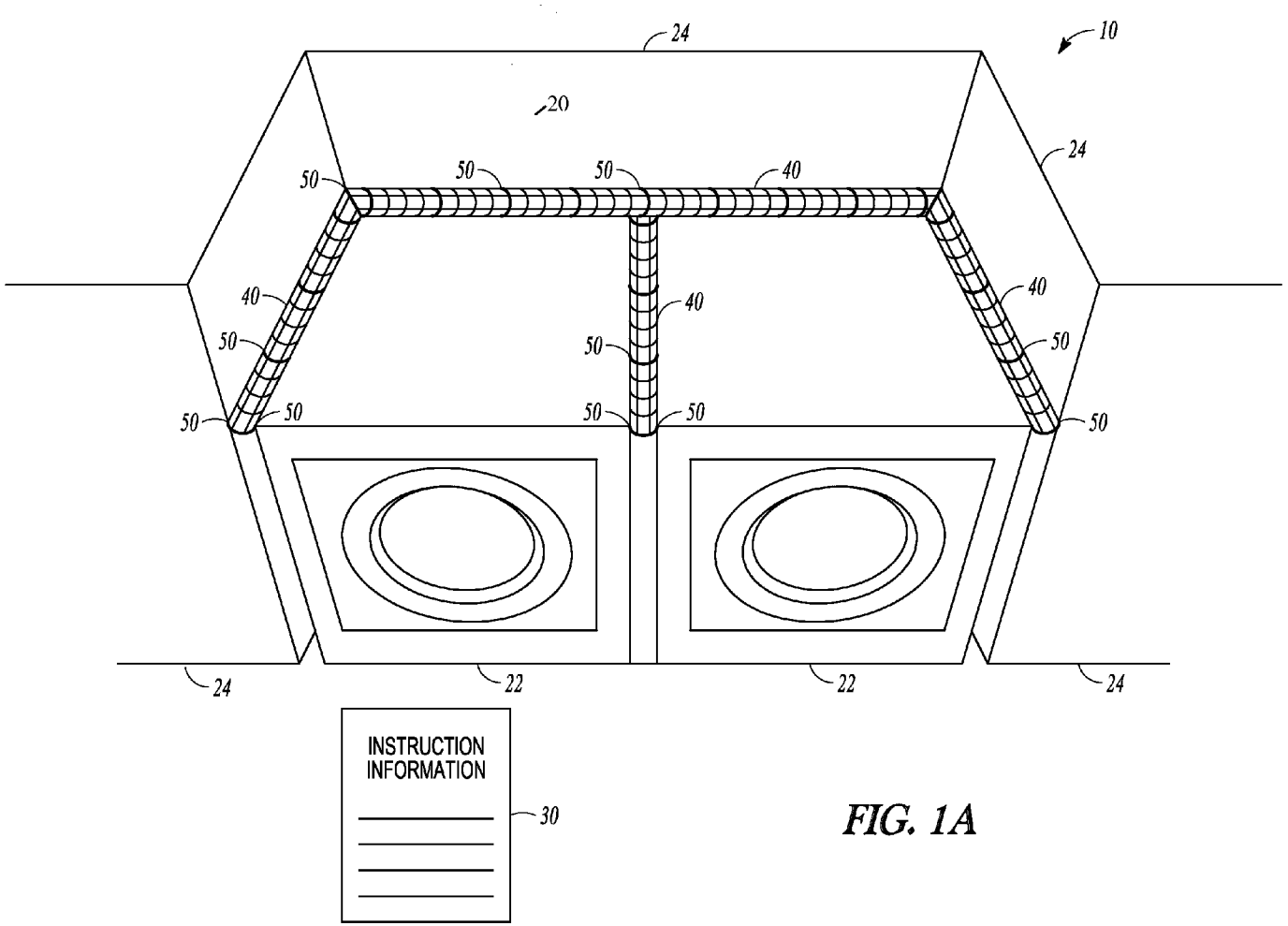
FIG. 1A is a diagram illustrating a system, according to an embodiment, for semi-moveable objects.

FIG. 1A illustrates a system 10 for semi-moveable objects, according to an embodiment. The system 10 may include a collection device 20 and instruction information 30. The collection device 20 may be used to immediately collect lightweight objects that otherwise fall between a semi-moveable object 22 (e.g., washer or dryer machine) and a supporting structure 24 (e.g., wall). Other semi-moveable objects 22 may include a table, shelf, piano, desk, another platform, a semi-moveable object, etc.). Other embodiments may include multiple supporting structures 24 and multiple semi-moveable objects 22. The instruction information 30 provides a set of instructions for installing the collection device 20.

The collection device 20 includes one or more capture mechanisms 40 and securing devices 50. The capture mechanisms 40 are affixed or fastened with one or more securing devices 50 to one or more supporting structures 24 to collect items. For example, the capture mechanisms 40 may catch lightweight objects that fall in the gap between the semi-moveable object 22 (e.g., washing machine) and the supporting structure 24 (e.g., wall) that would otherwise fall to the surface (e.g., flooring) supporting the semi-moveable object. Further for example, the capture mechanisms 40 may be stretched taut such that lightweight objects are supported by the capture mechanisms 40 negating any falling between the semi-moveable object 22 and the supporting structure 24. The supporting structure 24 may include another semi-moveable object 22 (e.g., washer machine or dryer machine) or another object (e.g., wall). It will be appreciated that the placement (e.g., side by side) of the semi-moveable objects 22 may result in a gap between the semi-moveable objects 22 and a nearby wall. As illustrated, this may present a problem in the form of a gap between the two machines or between either one of the machines and the wall. To be sure, the areas that surround the semi-moveable objects 22 may not be easily accessible due to the general immobility of the semi-moveable object 22. Therefore, the collection device 20 is desirable to keep clothing and other items that are lightweight from becoming misplaced or lodged between the semi-moveable objects. This typically occurs when the items are inadvertently pushed off the back or sides of the semi-moveable objects 22.

The capture mechanism 40 may be comprised of net-like material (e.g., net) or similar fabric according to various embodiments. The capture mechanism 40 act as a barrier that extends around vulnerable areas. For example, the vulnerable area may include a garage floor or other surface that periodically has oil, paint, paint thinner or some other spillage that may soil or damage a lightweight object. The capture mechanism 40 may be manufactured from monofilament (nylon, polypropylene, polyvinylidene fluoride, PVDF, polyethylene, Dacron), or other suitable material. In addition, the capture mechanism 40 may be secured, affixed, attached, fastened, adhered, nailed, tacked, etc. to the surfaces (e.g., back, sides, etc.) of supporting structures 24 to cover the gaps. The supporting structures 24 may include semi-moveable objects 22 and other objects including walls, overhead cabinets, etc.

The instruction information 30 may include a set of instructions for installing the collection device 20. For example, the instruction information 30 may include a set of steps that instruct a person to cut one or more capture mechanisms 40 from a larger piece of capture mechanism material and to fasten the capture mechanism(s) 40 to the one or more semi-moveable objects 22 and supporting structure(s) 24. The collection device 20 may be considered consumer friendly (e.g., easy to install) and well adapted for solving the described problem in different washer and dryer installations (e.g., side by side, low or high, pedestal) and in different washer dryer environments (e.g., garage, utility room, laundry room, etc.) as well as other applications including but not limited to those described below.

Figure 1B:
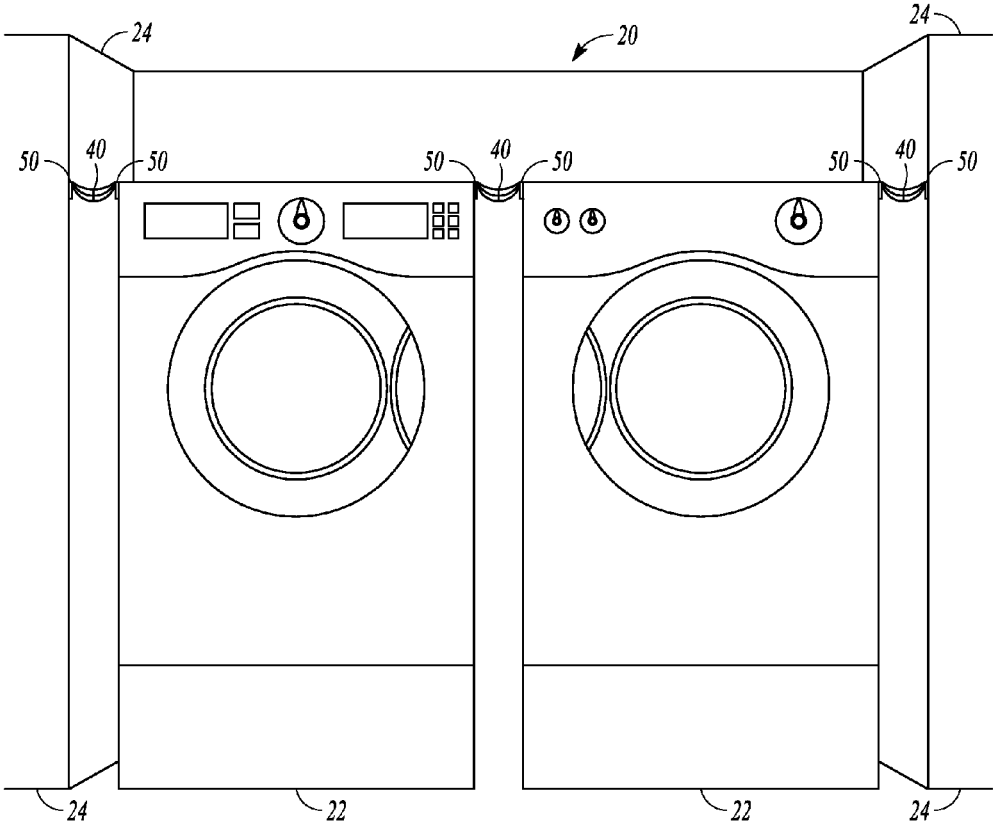
FIG. 1B is a diagram illustrating a collection device, according to an embodiment, for semi-moveable objects.

FIG. 1B further illustrates the collection device 20 for semi-moveable objects 22, according to an embodiment. The collection device 20 is illustrated according to a frontal view of two semi-moveable objects 22 respectively in the form of a washing machine and a drying machine. The collection device 20 may include multiple capture mechanisms 40. For example, illustrated is a first capture mechanism 40 acting as a barrier for a gap between the machine on the left and the supporting structure 24 on the left (e.g., wall); a second capture mechanism 40 acting as a barrier for a gap between the two machines; a third capture mechanism 40 acting as a barrier for a gap between the machine on the right and the supporting structure 24 on the right (e.g., wall); and a fourth capture mechanism 40 (not shown) acting as a barrier for a gap between both machines and the supporting structure 24 in back (e.g., wall) of both machines. The supporting structure 24 may include a wall, another semi-moveable object 22 or some other structure to which one or more capture mechanisms 40 are fastened. The present example illustrates the collection device 20 being attached to a single supporting structure 24. However, other embodiments may include the collection device 20 being attached to multiple supporting structures 24.

Figure 1C:
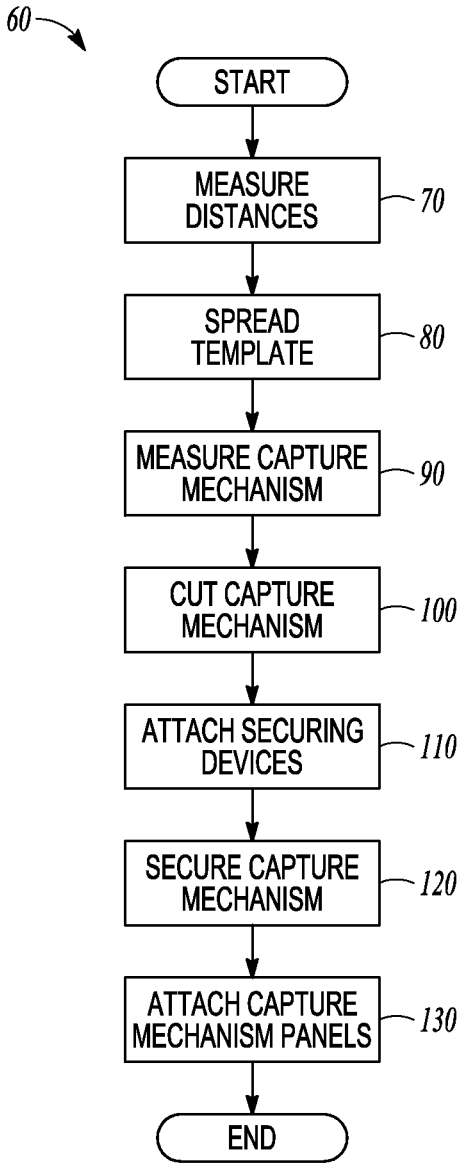
FIG. 1C is a block diagram illustrating a method, according to an embodiment, to install a collection device.

FIG. 1C is a block diagram illustrating a method 60, according to an embodiment, to install a collection device 20. The method 60 commences at operation 70 with a user measuring a distance between a supporting structure 24 (e.g., wall) and a semi-moveable object(s) 22 (e.g., appliance(s)) and noting the distances with a template (e.g., simple sketch), as illustrated in FIG. 1D, according to an embodiment.

Figure 1D:
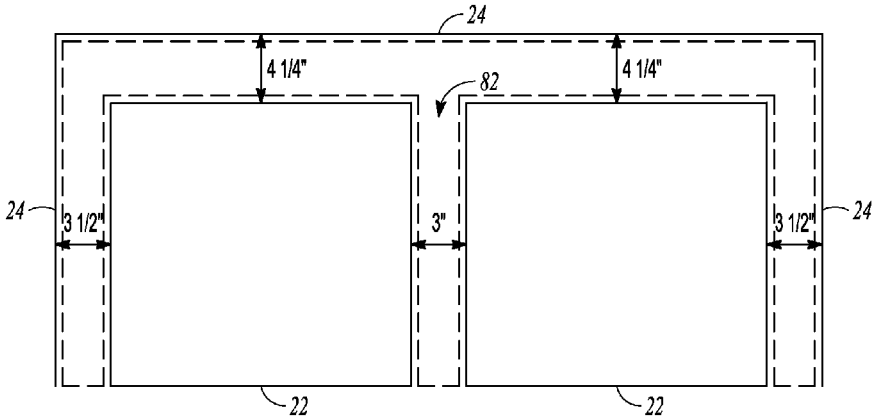
FIG. 1D is a block diagram illustrating a template, according to an embodiment.

FIG. 1D is a diagram illustrating a template 82, according to an embodiment. The template 82 is illustrated as outlined by a dashed line and positioned in the gaps between the semi-moveable objects 22 and the supporting structure 24. The template 82 may be comprised of paper, plastic, or the like and cut to fit in the gaps. The template 82 helps to ensure accuracy in subsequently cutting capture mechanism(s) 40 (not shown) from the capture mechanism material (not shown), as described later in this document. The measurements shown (e.g., 4.25," 3" and 3.50") are merely one set of example measurements. A slack measurement of 1½ inches may be added to all measurements to create slack in the capture mechanism 40 (not shown) (e.g., net). Other examples may utilize a different slack measurement. Without the addition of the slack measurement to the measurement of the gap, as represented by the template 82, the installation of the collection device 20 may be pulled loose by movement of the semi-moveable object 22 (e.g., appliance) (e.g., when a washing machine sways during use).

Returning to FIG. 1C, at operation 80, a user may spread or set the template 82 on a surface, preferably one that is flat. At operation 90, a user may measure the capture mechanism(s) 40 (e.g., net) in accordance with the template 82, using it as a guide, in marking the capture mechanism material. At operation 100, a user may cut the capture mechanism 40 from the capture mechanism material based on the measurements taken from the template 82. In some instances, the user may add the slack measurement in the appropriate places as described above. At operation 110, a user may attach the securing devices 50 (e.g., fasteners) to the one or more supporting structures 24 (e.g., walls) and the semi-moveable objects 22 (e.g., washer and dryer), as shown in FIG. 1E, according to an embodiment.

Figure 1E:
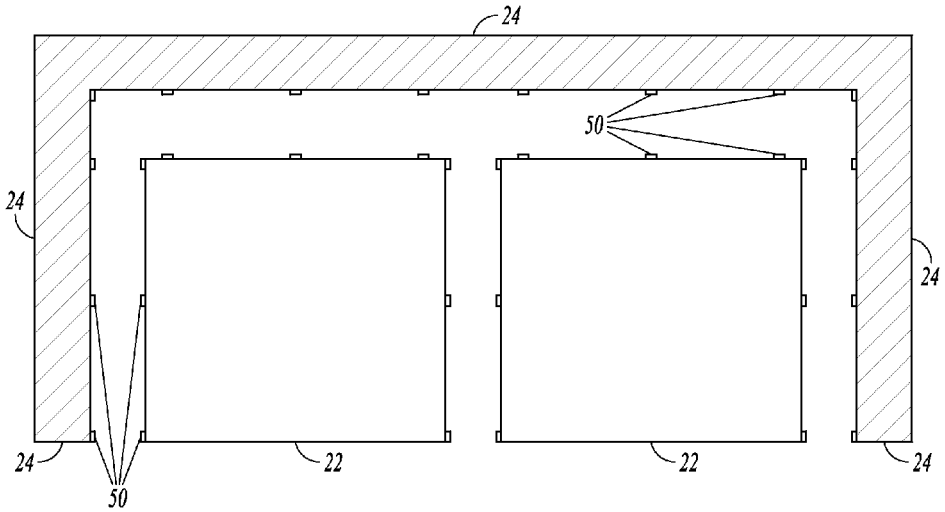
FIG. 1E is a diagram illustrating securing devices fastened to a supporting structure and semi-moveable objects, according to an embodiment.

FIG. 1E is a diagram illustrating securing devices 50 (e.g., fasteners) that are fastened to the one or more supporting structures 24 (e.g., wall) and the semi-moveable objects 22 (e.g., washer and dryer). Note that the securing devices 50 (e.g., fasteners) may be fastened to the supporting structures 24 (e.g., wall) and the semi-moveable objects 22 without the capture mechanism(s) 40 in place. In one embodiment, a plurality of securing devices 50 may include a first portion of securing devices 50 for fastening with the supporting structures 24 (e.g., wall) and a second portion of securing devices 50 for fastening with the semi-moveable objects 22

Returning to FIG. 1C, at operation 120, a user may secure (e.g., fasten) the capture mechanism(s) 40 (e.g., net) to the securing devices 50 (e.g., fasteners). Note that the present example includes multiple capture mechanisms 40 including a first, second, third and fourth capture mechanism (e.g., panel). Accordingly, in the present example, the user fastens the first, second, third, and fourth capture mechanisms 40 (e.g., nets) with the securing devices 50 (e.g., fasteners). Finally, at operation 130 (optional), a user may attach the capture mechanism 40 panels (e.g., net panels) together with the securing devices 50 (e.g., cable ties), as shown in FIG. 1F, according to an embodiment.

Figure 1F:
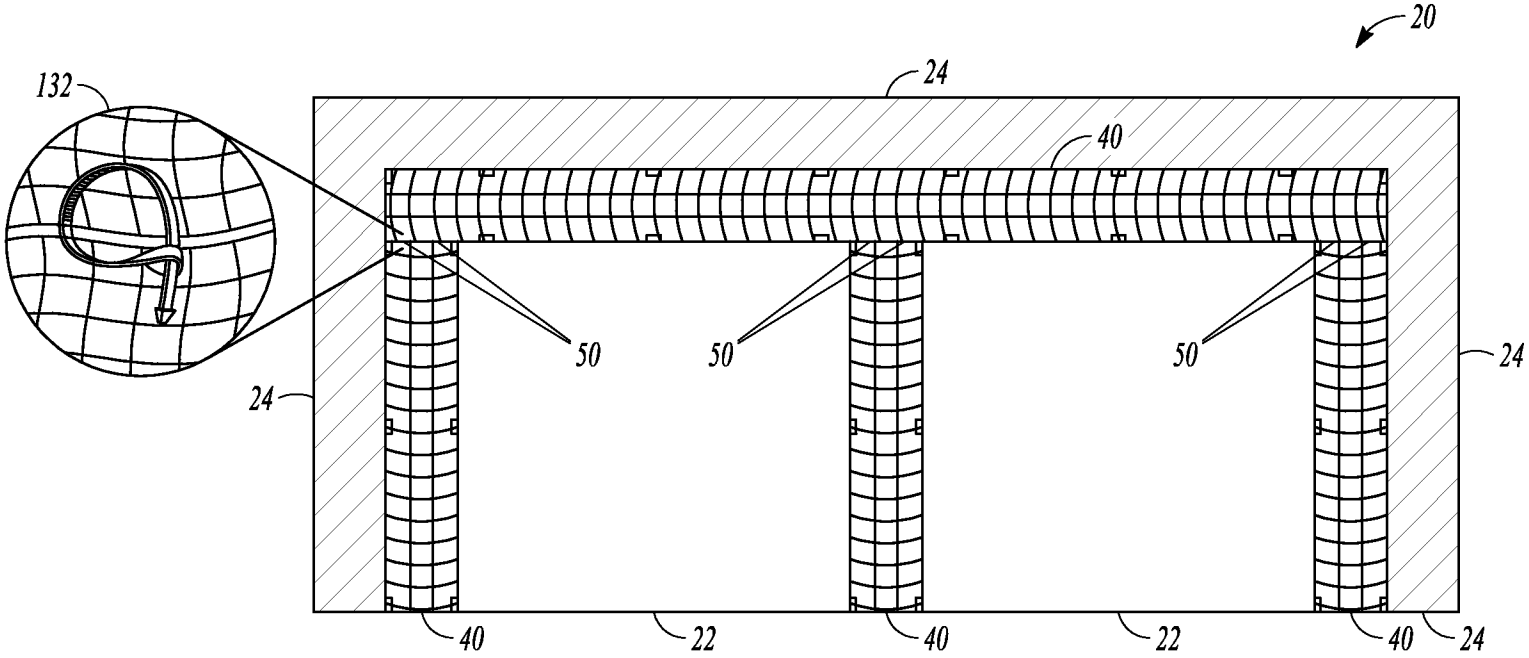
FIG. 1F is a diagram illustrating the collection device including multiple capture mechanisms fastened with cable ties, according to an embodiment.

FIG. 1F is a diagram illustrating a collection device 20 including four capture mechanisms 40 that are fastened with securing devices 50 (e.g., cable tie), according to an embodiment. A circle 132 magnifies a seam between two capture mechanisms 40 (e.g., a first capture mechanism on the left and a fourth capture mechanism in the back) and a securing device 50 attaching (e.g., fastening) the two capture mechanisms 40. For example, the securing device 50 may include a cable tie that is utilized to attach the two capture mechanisms 40 together. Other examples may utilize more than one cable tie to attach the two capture mechanisms 40 together. Two additional capture mechanisms 40 may be attached to the fourth capture mechanism 40 located behind the semi-moveable objects 22. For example, a second capture mechanism 40 located between the semi-moveable objects 22 may be attached to the fourth capture mechanism 40 and a third capture mechanism 40 located to the right of the semi-moveable object 22 on the right may be attached to the fourth capture mechanism 40.

Figure 1G:
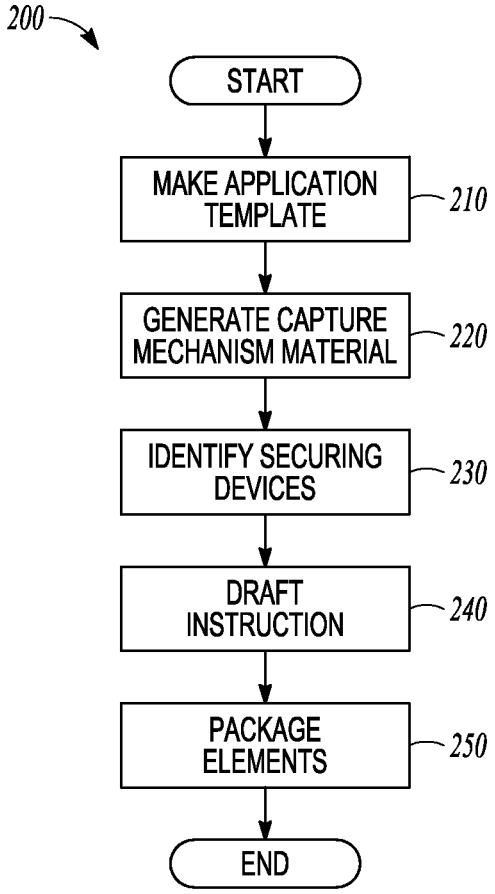
FIG. 1G is a block diagram illustrating a method, according to an embodiment, to manufacture and package a system for semi-moveable objects.

FIG. 1G is a block diagram illustrating a method 200, according to an embodiment, to manufacture and package a system 10 for semi-moveable objects. The method 200 may commence, at operation 210, with a manufacturer making an application template. The application template may be made for a particular application (e.g., washing machines, shop work benches, book shelf) or for a group of applications that are related (e.g., kitchen appliances, furniture, etc.). Further, the application template may be made from wood, metal, plastic or some other suitable material. Application templates are of different length and width dimensions in accordance with different applications or groups of applications. For example, an application template for a first application may have a longer length than an application template for a second application. Further for example, an application template for a third application may have a wider width than an application template for a fourth application. One having ordinary skill in the art recognizes that other combinations of different width and/or different length may be realized for different applications.

At operation 220, the manufacturer may generate individual units of capture mechanism material. The manufacturer may generate an individual unit of the capture mechanism material from basic raw material, according to one embodiment, based on the application template. The manufacturer may generate the individual unit of the capture mechanism material by applying the appropriate cuts to basic raw material based on the application template to generate capture mechanism material. Accordingly, the individual unit of capture mechanism material is generated for a particular application or group of applications in accordance with the application template. The generating of the capture mechanism material for a particular application or group of applications enables an economizing of the capture mechanism material for a user who purchases a system 10 for semi-moveable objects and cuts one or more capture mechanisms 40 (not shown) from the capture mechanism material generated for a particular application or group of applications.

According to another embodiment, the manufacturer may utilize numerically controlled machines or computer automated machines that are programmed to make the appropriate cuts to generate the capture mechanism material. According to another embodiment the manufacturer may utilize numerically controlled machines or computer automated machines that are programmed to manufacture one or more units of capture mechanism material from raw materials like metal, plastic, polyethylene, fabric threads etc. According to the latter embodiment, cutting is not required as the units of capture mechanism material are manufactured to fit.

At operation 230, the manufacturer may identify one or more types of securing devices 50 from different types of securing devices 50 and a quantity of the identified types of securing devices 50 for a single system 10. The manufacturer may identify the one or more types of securing devices 50 based on the application (e.g., washing machine and drying machine).

At operation 240, the manufacturer may draft instruction information 30 (e.g., instructions) based on the application that was selected. The instruction information 30 may include steps to cut the capture mechanism 40 from the capture mechanism material and fasten capture mechanism 40 to supporting structures with securing devices 50 to form the collection device 20. As previously described, the instructions a system 10 for an appliance application (e.g., washing and drying machine) may be different from the instructions for a system 10 for a book shelf application.

At operation 250, the manufacturer may package the elements that comprise the system 10 in a container device (e.g., plastic bag that is marked), the elements comprising capture mechanism material from which the capture mechanism 40 may be cut, an approximation of an identified number of securing devices 50 (e.g., fasteners) comprised of different types of securing devices 50 and instruction information 30. The capture mechanism material is generated based on a particular application or group of applications, the numbers and types of securing devices 50 are selected based on the particular application or group of applications and the instruction information provides instruction directed at the particular application or groups of applications. Packaging may be manually or automatically implemented.

Figure 2:
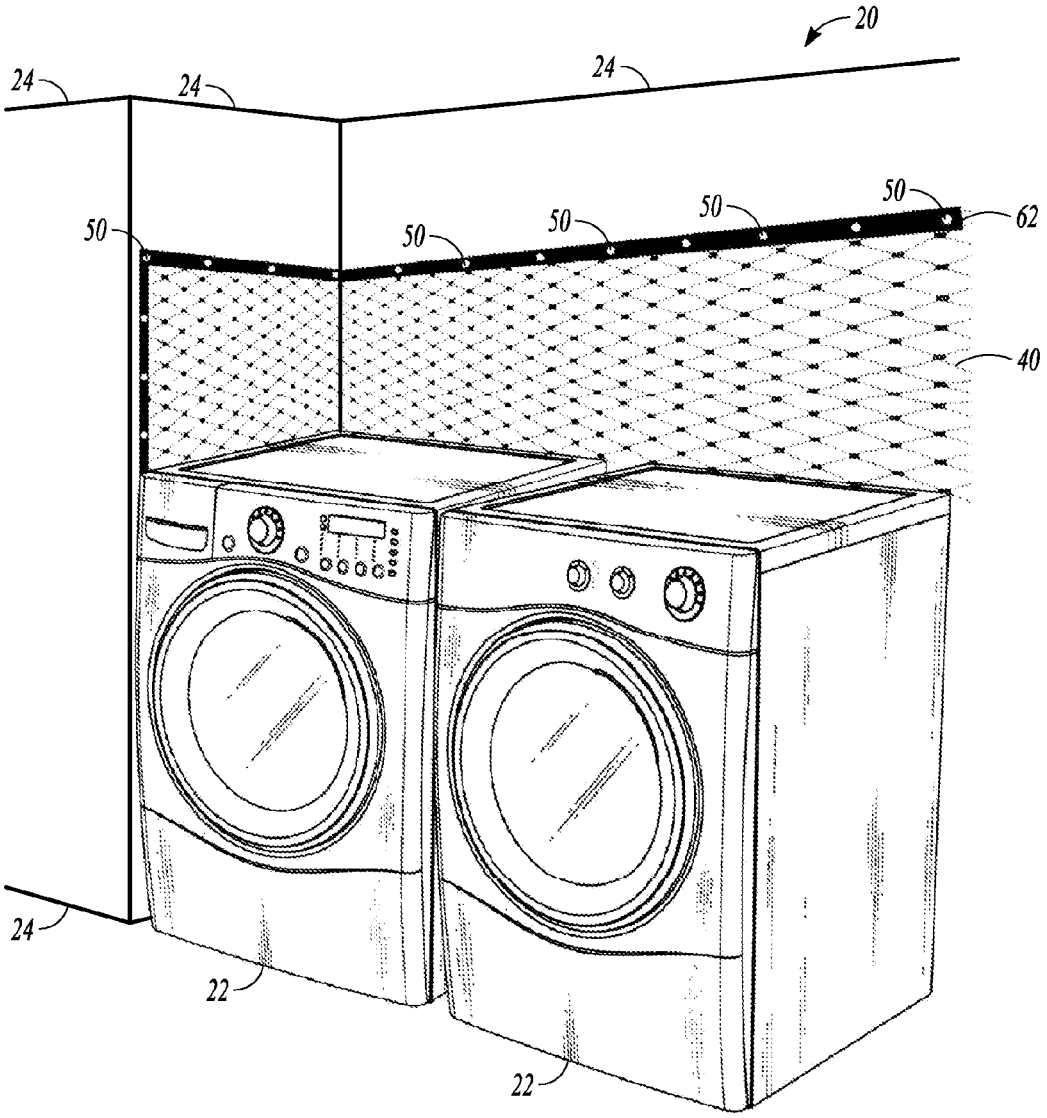
FIG. 2 is a diagram illustrating a collection device, according to an embodiment.

FIG. 2 further illustrates a collection device 20 for semi-moveable objects, according to an embodiment. The collection device 20 is illustrated according to a perspective frontal-side-top view of two semi-moveable objects 22 in the form of a washing machine and a drying machine. The collection device 20 may include a single capture mechanism 40 that wraps around the backs of the washing machine and the drying machine and further around one side of the washing machine. The capture mechanism 40, as illustrated, acts as a barrier that blocks lightweight objects from falling into the gap between the semi-moveable object 22 and the supporting structure 24. The collection device 20 may be attached to supporting structures with multiple securing devices 50. The capture mechanism 40 may be bordered one or more sides with band material 62 that provides additional strength to the edges of the capture mechanism 40.

Figure 3A:
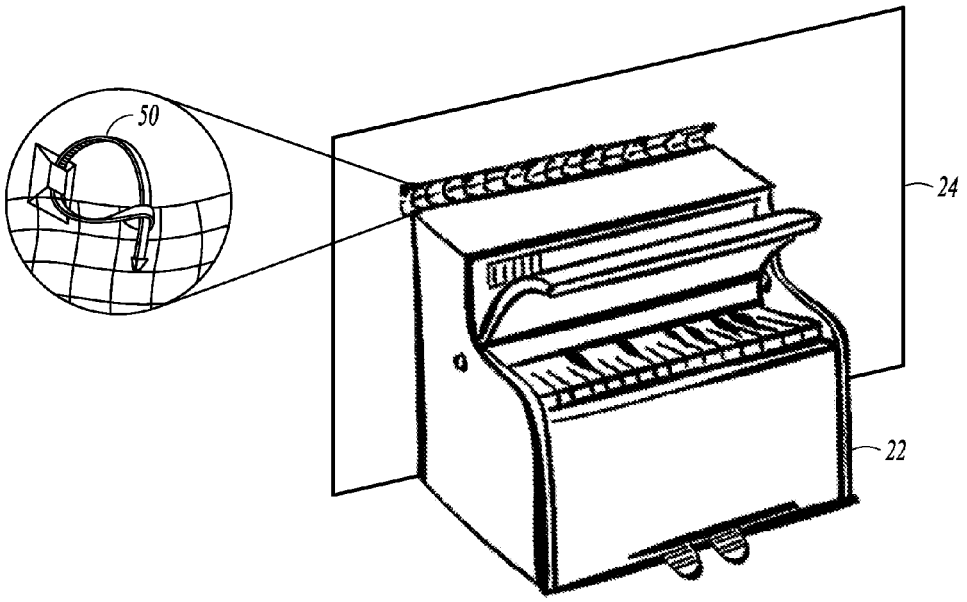
FIGS. 3A-3F are drawings illustrating a securing device, according to various embodiments.

FIG. 3A-FIG. 3F illustrate a securing device 50, according to various embodiments. FIG. 3A is a drawing illustrating a securing device 50 in the form of a cable tie with a self-adhesive mounting base, according to an embodiment. The cable tie with a self-adhesive mounting base includes an adhesion member and a strap member. The adhesion member is presently illustrated in the form of an adhesive mounting base. The adhesive mounting base is fastened to a surface of a supporting structure 24 or a semi-moveable object 22. The strapping member may be utilized to strap one or more capture mechanisms 40. The secure device 50 may further include a cable-tie by itself without a nail hole or mounting base as shown on FIG. 1F in callout 132.

Figure 3B:
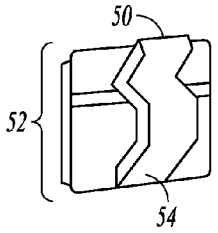

FIG. 3B is a drawing illustrating a securing device 50 in the form of a self-adhesive clip, according to an embodiment. The self-adhesive clip includes an adhesion member 52 and a clipping member 54. The adhesion member 52 may be fastened to a surface of a supporting structure 24 or a semi-moveable object 22. The clipping member 54 may be clasped to one or more capture mechanisms 40.

Figure 3C:
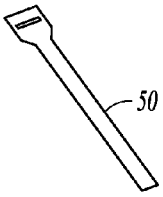

FIG. 3C is a drawing illustrating a securing device 50 in the form of a Velcro® strap, according to an embodiment. The Velcro® strap may operate in a similar manner as the self-adhesive clip by including an adhesion member (e.g., Velcro® surface coupled to strap) and a strapping member (e.g., e.g., strap).

Figure 3D:
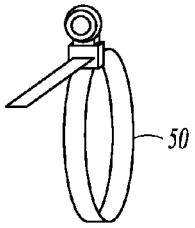

FIG. 3D is a drawing illustrating a securing device 50 in the form of a cable tie with a mounting hole, according to an embodiment. The cable tie may operate in a similar manner as the self-adhesive clip by including a fastening member (e.g., mounting hole in a base coupled to strap) and a strapping member (e.g., e.g., strap). The mounting hole may receive a screw, nail or the like for fastening the base to a surface. The strap may be threaded through one or more capture mechanisms 40.

Figure 3E:
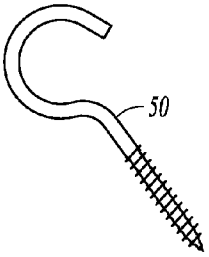

FIG. 3E is a drawing illustrating a securing device 50 in the form of a screw-in hook, according to an embodiment. The screw in hook may operate in a similar manner as the self-adhesive clip by including a fastening member (e.g., threaded screw coupled to hook) and a hooking member (e.g., e.g., hook). The screw may receive pressure and a twisting motion to fasten the securing device 50 to a surface. The hook may be threaded through one or more capture mechanisms 40.

Figure 3F:
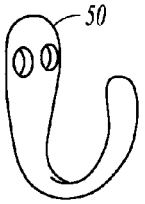
Figure 4A:
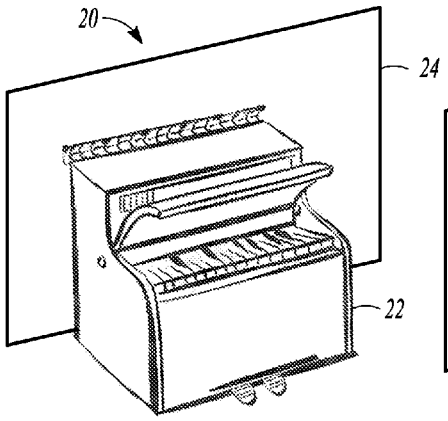
FIGS. 4A-4F are drawings illustrating a collection device, according to various embodiments.
Figure 4B:
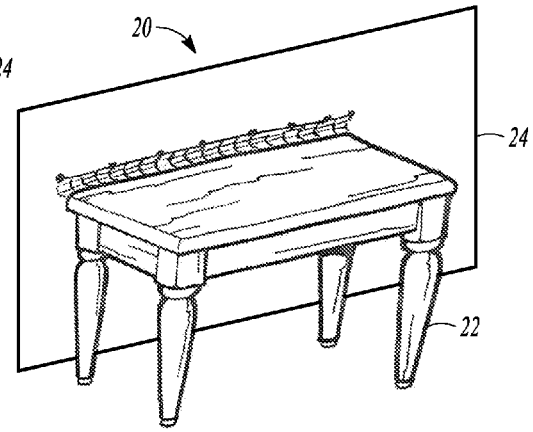
Figure 4C:
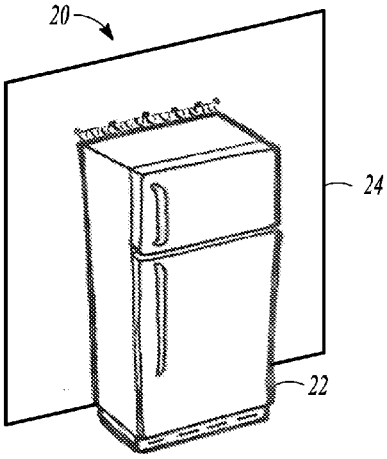
Figure 4D:
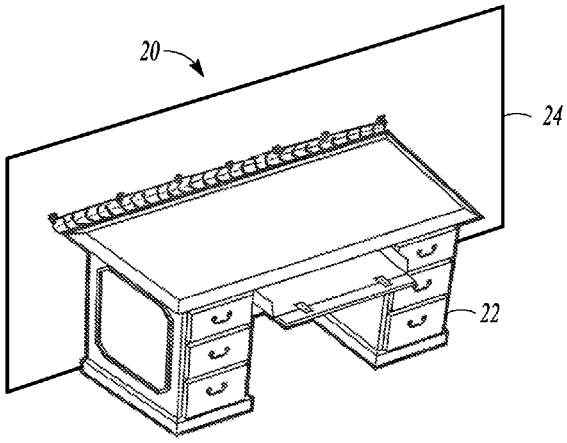
Figure 4E:
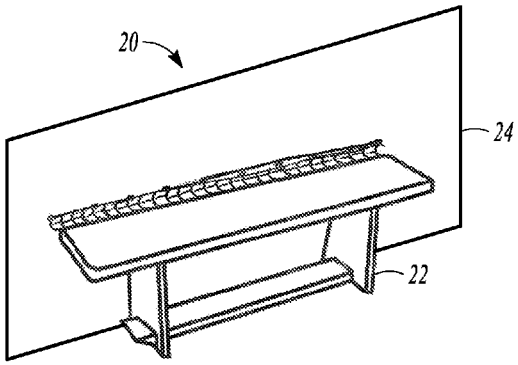
Figure 4F:
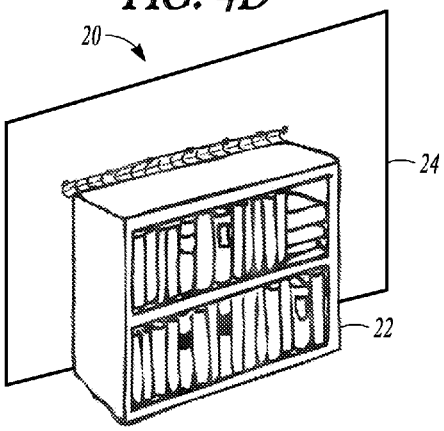

FIG. 3F is a drawing illustrating a securing device 50 in the form of a hook with screw holes, according to an embodiment. The securing device 50 may further include a hook with a single screw hole (not shown) or greater than two screw holes (not shown). The screws may include a screw in the form of a sheet metal screw, a wood screw, or other types of screws that are suitable for fastening to different materials and/or surfaces. The hook with screw holes may operate in a similar manner as the self-adhesive clip by including a fastening member (e.g., hole in base coupled to hook) and a hooking member (e.g., e.g., hook).

Accordingly, the securing device 50 may include a screw mechanism (e.g., screw, screw-in hook), a hook mechanism (e.g., hook, screw-in hook, hook with screw holes, hook with screw hole), a cable tie mechanism (e.g., cable tie, cable tie with nail hole, cable tie with self-adhesive mounting base), an adhesive mount mechanism (e.g., adhesive mount, self-adhesive clip), and a Velcro® mechanism (e.g., Velcro®, Velcro® strap). It will be understood by one having ordinary skill in the art that the fastening devices are not limited to screws, hooks, cable ties, and Velcro®, but may include any form of fastening mechanism including drywall anchors, self-adhesive hooks, magnets, and other such methods that are suitable for securing and attaching the capture mechanism 40.

FIG. 4A-FIG. 4F further illustrates semi-moveable objects 22 with collection devices 20, according to multiple embodiments. The collection devices 20 may be utilized in the same manner as described above for the washer/dryer (e.g., preventing items from falling into gaps between semi-moveable objects and supporting structures). As presently illustrated, the collection device 20 may prevent items from falling into gaps between supporting structures 23 and a semi-moveable object 22 in the form of a table, a bench, a dresser, a piano, a refrigerator, or a desk.

Although an embodiment has been described with reference to specific example embodiments, it will be evident that various modifications and changes may be made to these embodiments without departing from the broader spirit and scope of the disclosure. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

We claim:

1. A collection device to capture a lightweight object, the collection device comprising:

at least one capture mechanism including a first capture mechanism and a second capture mechanism; and a first plurality of securing devices including a first type of securing device, the first plurality of securing devices including a first portion of securing devices and a second portion of securing devices, the first portion of securing devices respectively fasten the first capture mechanism to a supporting structure and the second portion of the first plurality of securing devices to respectively fasten the first capture mechanism to at least two semi-moveable objects to enable the at least one capture mechanism to capture a lightweight object that falls between the supporting structure and the at least two semi-moveable objects, the first plurality of securing devices including a second plurality of securing devices including a second type of securing device, the second plurality of securing devices being utilized to fasten at least two of the capture mechanisms to each other, the second plurality of securing devices including a second securing device, the second capture mechanism is fastened to the first capture mechanism with the second securing device.

2. The collection device of claim 1, wherein the first type of securing device includes a self-adhesive clip type including an adhesion member and a clipping member and wherein the first plurality of securing devices includes a first securing device that is a self-adhesive clip.

3. The collection device of claim 2, wherein the adhesion member of the self-adhesive clip adheres to the supporting structure and wherein the clipping member of the self-adhesive clip clasps the first capture mechanism.

4. The collection device of claim 1, wherein the at least one capture mechanism includes a third capture mechanism and a fourth capture mechanism.

5. The collection device of claim 4, second securing device is a cable-tie.

6. The collection device of claim 1, wherein the at least one capture mechanism is manufactured from a monofilament and wherein the monofilament includes nylon, polypropylene, polyvinylidene, flouride and dacron.

7. The collection device of claim 1, wherein the first capture mechanism is bordered on at least one side with band material.

8. The collection device of claim 7, wherein the band material strengthens the at least one edge of the first capture mechanism.

9. The collection device of claim 1, wherein the at least one type of securing device includes a hook and loop fastener type, a cable tie with nail hole type, a screw in hook type, and a hook with screw hole type.

10. A system for one or more semi-moveable objects, the system comprising:

a container device including:

capture mechanism material;

a plurality of securing devices including a first plurality of securing devices; and instruction information, the instruction information providing instructions to install a collection device to capture a lightweight object by cutting the capture mechanism material to generate at least one capture mechanism and fastening the at least one capture mechanism with a first plurality of securing devices to at least two semi-moveable objects and a supporting structure, the collection device comprising:

the at least one capture mechanism including a first capture mechanism and a second capture mechanism, and the first plurality of securing devices including a first type of securing device, the first plurality of securing devices including a first portion of securing devices and a second portion of securing devices, the first portion of securing devices respectively fasten the first capture mechanism to at the least one supporting structure and the second portion of the first plurality of securing devices to respectively fasten the first capture mechanism to at least two semi-moveable objects to enable the at least one capture mechanism to capture a lightweight object that falls between the supporting structure and the at least two semi-moveable objects, the first plurality of securing devices including a second plurality of securing devices including a second type of securing device, the second plurality of securing devices being utilized to fasten at least two of the capture mechanisms to each other, the second plurality of securing devices including a second securing device, the second capture mechanism is fastened to the first capture mechanism with the second securing device.

11. The system of claim 10, wherein the first type of securing device includes a self-adhesive clip type including an adhesion member and a clipping member and wherein the first plurality of securing devices includes a first securing device that is a self-adhesive clip.

12. The system of claim 11, wherein the adhesion member of the self-adhesive clip adheres to the supporting structure and wherein the clipping member of the self-adhesive clip clasps the first capture mechanism.

13. The collection device of claim 10, wherein the at least one capture mechanism includes a third capture mechanism and a fourth capture mechanism.

14. The collection device of claim 13, second securing device is a cable-tie.

15. The system of claim 10, wherein the at least one capture mechanism is manufactured from a monofilament and wherein the monofilament includes nylon, polypropylene, polyvinylidene, flouride and dacron.

16. The system of claim 10, wherein the first capture mechanism is bordered on at least one edge with band material.

17. The system of claim 16, wherein the band material strengthens the at least one edge of the first capture mechanism.

18. The system of claim 10, wherein the at least one type of securing device includes a hook and loop fastener type, a cable tie with nail hole type, a screw in hook type, and a hook with screw hole type.

* * * * *